United States Patent [19]

Ring

[11] Patent Number: 4,658,917

[45] Date of Patent: Apr. 21, 1987

[54] ENCLOSED JAR TOOL

[75] Inventor: Curtis P. Ring, Millarville, Canada

[73] Assignee: Bralorne Resources Limited, Alberta, Canada

[21] Appl. No.: 775,106

[22] Filed: Sep. 9, 1985

Related U.S. Application Data

[63] Continuation of Ser. No. 531,733, Sep. 13, 1983, abandoned.

[51] Int. Cl.[4] ..... E21B 4/14

[52] U.S. Cl. ..... 175/297; 166/178; 175/299

[58] Field of Search ..... 175/296, 297, 299; 166/178

[56] References Cited

U.S. PATENT DOCUMENTS

| | | | |
|---|---|---|---|
| 3,208,541 | 9/1965 | Lawrence | 175/299 |
| 3,949,821 | 4/1976 | Raugust | 175/297 |
| 4,111,271 | 9/1978 | Perkins | 175/297 |
| 4,361,195 | 11/1982 | Evans | 175/299 |

*Primary Examiner*—Stephen J. Novosad
*Assistant Examiner*—William P. Neuder
*Attorney, Agent, or Firm*—John R. Uren

[57] ABSTRACT

A jar tool having a mandrel and a housing substantially surrounding said housing. The mandrel and housing are splined such that they may move longitudinally relative to each other. First and second pairs of abutment faces for the jar and bump strokes respectively, are provided between the mandrel and the housing. Both sets of abutment faces are enclosed within the jar tool.

8 Claims, 10 Drawing Figures

ENCLOSED JAR TOOL

This is a continuation of application Ser. No. 531,733 filed Sept. 13, 1983, now abandoned.

INTRODUCTION

This application relates to jar tools and, more particularly, to two way jar tools that have both a bump and jar stroke.

BACKGROUND OF THE INVENTION

Jar tools are used to free stuck drill pipe or well tools. They provide a substantial shock to the drill string which is transmitted to the stuck tool or "fish" and which is helpful in dislodging it.

Hydraulic jars are jar tools using hydraulic fluid as the working fluid. In these jars, an example of which is disclosed in U.S. Pat. No. 3,949,821, owned by the applicant, a piston is provided which restricts the flow of hydraulic fluid from one side of the piston to the other when the piston is in its home or rest position. It may, however, be moved from its home position to an enlarged area where the fluid is able to rush by the piston allowing the housing and mandrel to impact thus causing the jar. Following the jar, the driller may compress the tool which causes a bump. While the impact or abutment surfaces on the jar stroke are located inside the housing, the bump surfaces are located on the outside of the housing.

It will be noted that the term "jar" refers to the impact caused when the jar tool is placed under a tension load and, similarly, the term "bump" is the impact caused when the jar tool is placed under a compression load.

This construction, however, suffers disadvantages. Since the bump abutment surfaces are located externally of the housing, they are exposed to mud and drill cuttings which create wear. Further, since the mud and cuttings are pressed between the abutment faces when the bump impact occurs, a small amount may be forced through the seals with great pressure. This "squeeze film effect" can cause seal deterioration and bushing and drive spline wear and galling.

SUMMARY OF THE INVENTION

According to the present invention, there is disclosed a jar tool comprising a mandrel adapted for connection to a piece of drill string at one end of said tool, a housing axially movable relative to said mandrel and adapted for connection to said drill string at the opposite end of said tool, a first and second pair of abutment faces between said mandrel and said housing defining jar and bump positions of said tool, respectively, piston means operable to regulate the passage of hydraulic fluid from one side of said piston to the other, and sealing means between said housing and mandrel operable to seal said first pair of abutment faces from outside contamination, said first and second pair of abutment faces being enclosed within said jar tool.

BRIEF DESCRIPTION OF THE SEVERAL VIEWS OF THE DRAWINGS

In drawings, which illustrate an embodiment of the invention.

DESCRIPTION OF SPECIFIC EMBODIMENT

Figure 1:
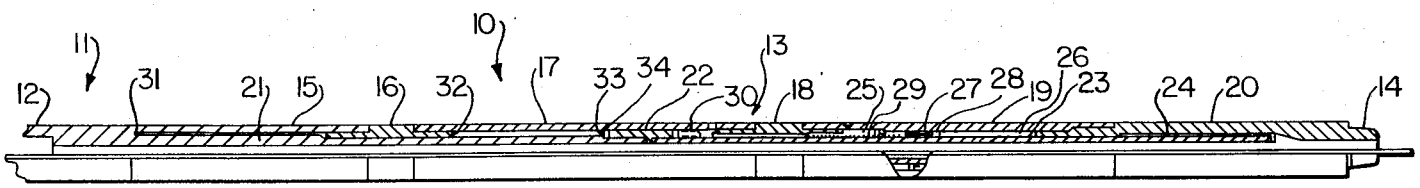
FIG. 1 is a cross-sectional view of a known jar tool.
Figure 1A:
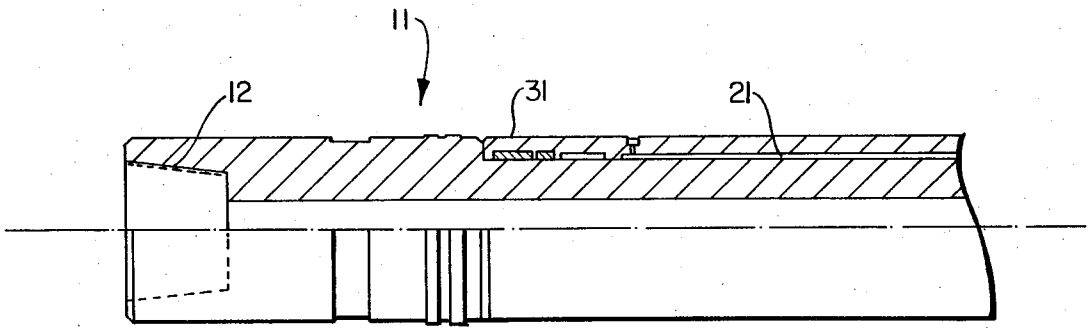
FIGS. 1A, 1B, 1C and 1D are enlarged partial cross-sectional views of the jar tool taken from the top to the bottom in FIG. 1, respectively.
Figure 1B:
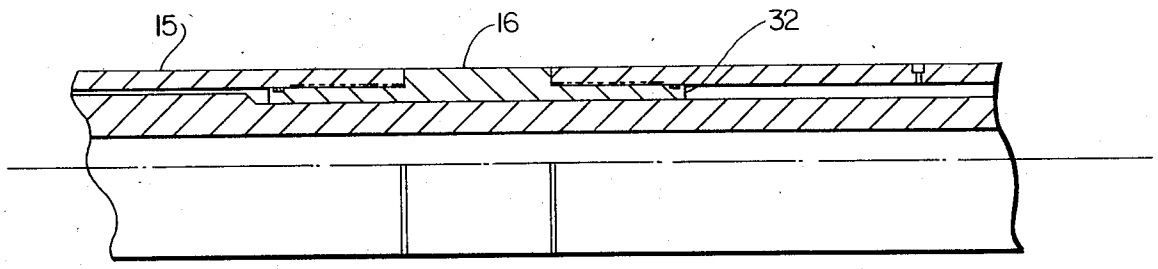
Figure 1C:
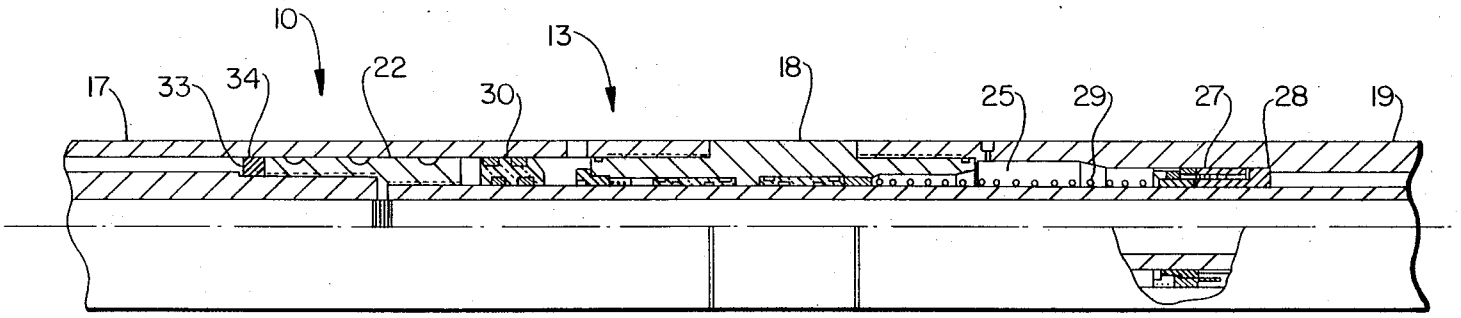
Figure 1D:
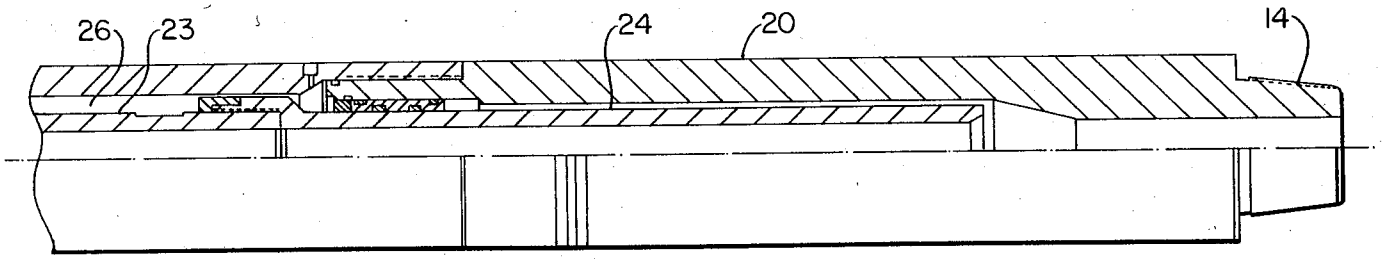

Referring to FIGS. 1 and 1A through 1D, a jar tool is generally denoted 10. It comprises a mandrel generally denoted 11 adapted to be connected to a length of drill string or collar (not shown) by threaded connection 12. A housing generally denoted 13 surrounds the mandrel 11 and extends to an opposite end which is adapted to be connected to a piece of drill string or collar (not shown) through threaded connection 14.

The housing 13 comprises a sealing housing 15 connected to spline housing 16. Spline housing 16 is connected to knocker housing 17 which, in turn, is connected to packing sub 18. Packing sub 18 is connected to hydraulic cylinder 19 which is connected to washpipe housing 20 having threaded connection 14.

Mandrel 11 comprises a spline mandrell 21 connected to knocker 22. Knocker 22 is connected to piston mandrel 23 which, in turn, is connected to washpipe 24.

Hydraulic fluid is enclosed within cavities 25, 26 between the hydraulic cylinder 19 and the piston mandrel 23. A piston 27 is provided which is movable off shoulder 28 and which restricts the flow of hydraulic fluid from cavity 25 to cavity 26. Valves or metering devices (not shown) are provided within the piston 27 to allow adjustable release force on the jar tool 10 and to provide for a more constant fluid flow through the piston 27. A return mechanism in the form of spring 29 is provided to keep the piston 27 against shoulder 28 and to return the piston 27 to shoulder 28 following the jar stroke.

A knocker gland 30 is positioned between knocker housing 17 and piston mandrel 23. It seals the oil filled chambers from the drill mud and acts to equalize pressures inside and outside the jar tool 10. The knocker gland 30 moves in response to temperature and pressure variations.

There are two pairs of abutment surfaces on the jar tool 10. The first pair generally denoted 31 are located one on the spline mandrel 21 and the other on the sealing housing 15. This first pair 31 define the impact position on the bump stroke of the jar tool 10. The second pair of abutment faces are denoted 32, 33 respectively. Abutment face 32 is located on spline housing 16 and abutment face 33 is located on impact ring 34 which is held in position by knocker 22 and travels with the mandrel 11. Abutment faces 32, 33 impact on the jar stroke.

Figure 2:
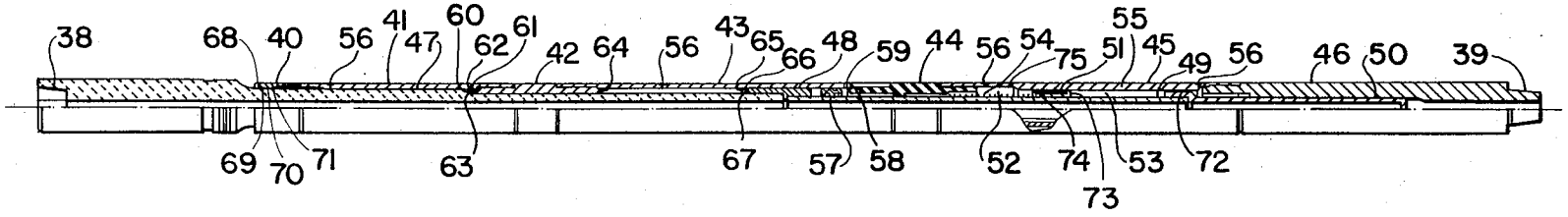
FIG. 2 is a cross-sectional view of the jar tool according to the present invention.
Figure 2A:
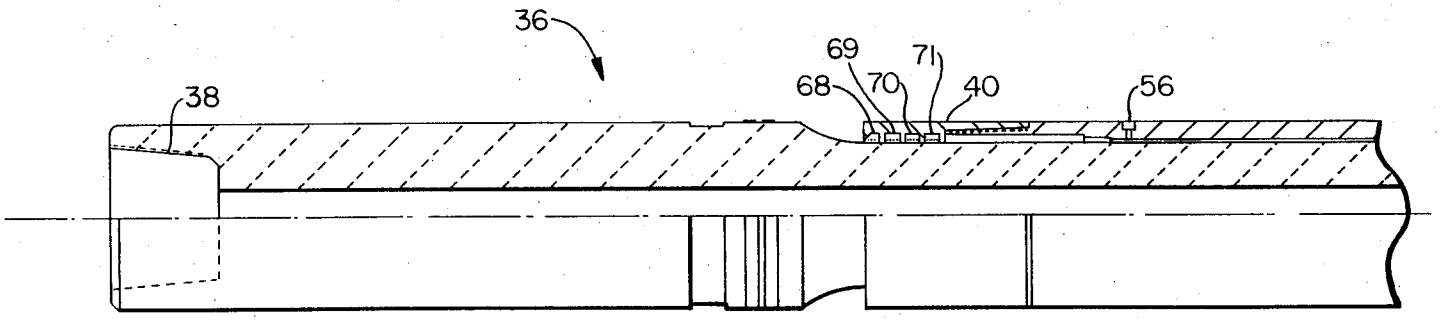
FIGS. 2A, 2B, 2C and 2D are enlarged partial cross-sectional views of the jar tool taken from the top to the bottom in FIG. 2, respectively.
Figure 2B:
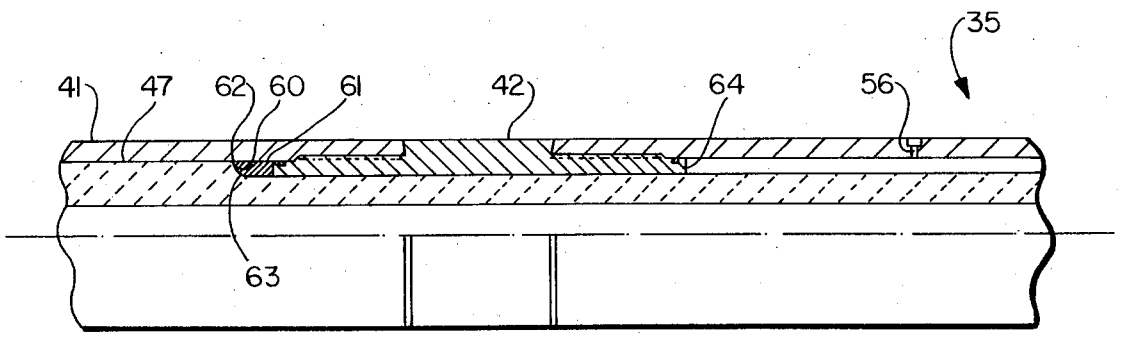
Figure 2C:
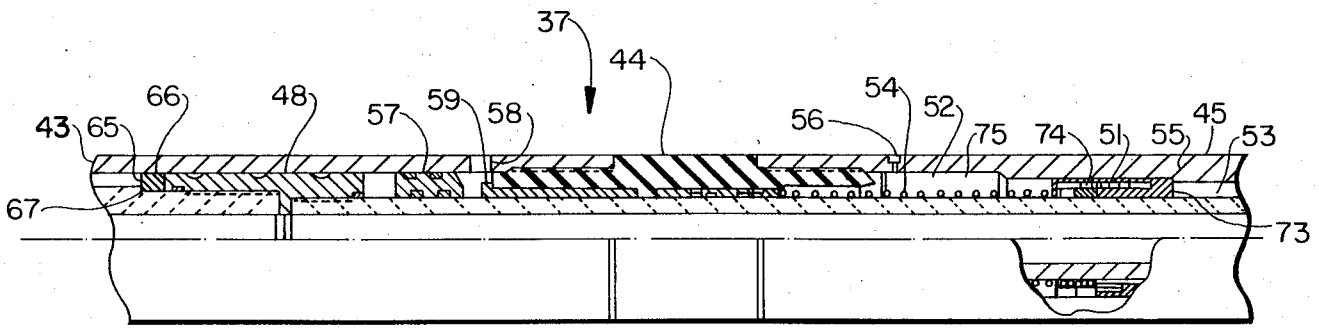
Figure 2D:
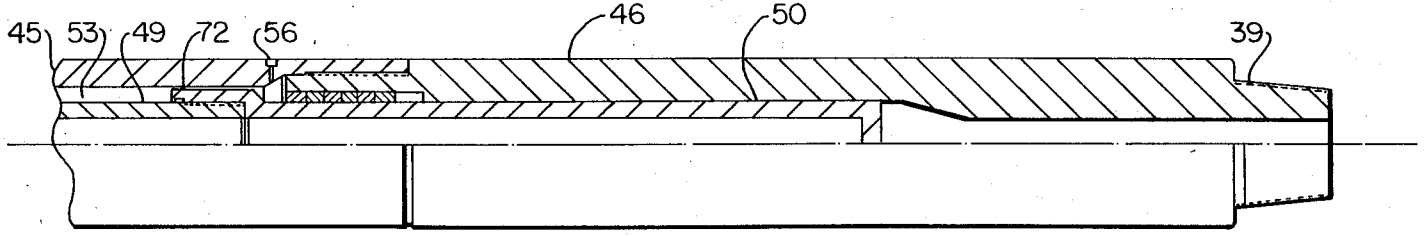

Referring now to FIGS. 2 and 2A through 2D, the jar tool of the present invention is generally denoted 35. It comprises a mandrel generally shown at 36 and a housing generally shown at 37. The mandrel 36 is connected to drill pipe at one end through threaded connection 38 and the housing 37 is connected to drill pipe at the other end by threaded connection 39.

The housing 37 comprises, from left to right, end cap 40, sealing housing 41, spline housing 42, knocker housing 43, packing sub 44, hydraulic cylinder 45 and washpipe housing 46, all connected.

The mandrel 36 comprises, from left to right, spline mandrel 47, knocker 48, piston mandrell 49 and washpipe 50, all connected.

A piston 51 is provided which acts to restrict fluid flow between chambers 52, 53 respectively. A spring 54 acting between the packing sub 44 and piston 51 seats the piston 51 on a shoulder 55 on hydraulic cylinder 45 following the jar stroke.

Four removable oil fill plugs 56 are inserted into the housing 37. The fill plugs 56 are mounted, one in each of the sealing housing 41 and the knocker housing 43, respectively, and two in the hydraulic cylinder 45.

A knocker gland 57 is fitted around piston mandrel 49 and is movable relative thereto between knocker 48 and packing sub 44 to equalize pressure and to seal the oil filled chambers from the drill mud which can enter the jar tool 10 through the aperture 58. An upper gland nut 59 is inserted around the packing sub 44.

A first set of abutment surfaces is shown generally at 60. These surfaces abut and define the impact position during the bump surface. A first impact ring 61 is provided. The impact ring 61 is held in position against a shoulder 62 by spline housing 42. The impact ring 61 impacts against a shoulder 63 on spline mandrel 47.

The second set of abutment surfaces are defined by 64, 65 respectively. Abutment face 64 is on spline housing 42 and abutment face 65 is on second impact ring 66. Second impact ring 66 is held in position against a shoulder 67 on spline mandrel 47 by knocker 48.

Both the first and second set of abutment faces 60 and 64, 65 respectively are enclosed within the jar tool 35.

End cap 40 is connected to sealing housing 41 and terminates the housing 37. A wiper 68 and three seals 69, 70, 71 seal the inside of the housing 37 from the outside mud and other foreign substances which can cause contamination and undesirable wear if they are allowed to enter the jar tool.

OPERATION

Both embodiments operate substantially along similar lines and, therefore, only the operation of the embodiment depicted in FIGS. 2 and 2A through 2D will be described.

The jar tool 35 is shown in its collapsed or bump position and, it will be assumed, is connected to respective pieces of the drill string (not shown) at both ends. The driller, to perform the jar operation, will create a tension force on the jar tool 35 by raising the drill string. This will cause the mandrel 36 to move upwardly in operating condition or leftwardly in the drawings relative to the housing 37. The housing 37 will remain stationary since it is connected to the stuck tool or fish. As the mandrel 36 moves, the abutment surfaces 60 separate and piston 51 is held in position against shoulder 55 on hydraulic cylinder 45 by piston return spring 54 until the piston actuator 72 contacts the piston 51. Until this time, fluid has freely flowed between chambers 52, 53 past the inside diameter of piston 51. When the piston actuator 72 contacts piston 51, seal 73 seals against piston actuator 72 and the fluid may then only pass through the metering passageway 74 in piston 51. The piston 51 will move leftwardly under the influence of piston actuator 72 with the restriction to fluid passage past piston 51 causing very high fluid pressure in chamber 52. When the seal on piston 51 enters the enlarged area 75 of chamber 52, the hydraulic fluid rushes by the piston 51 and into chamber 53. The release of this fluid allows a large acceleration to occur between the housing 37 and mandrel 36 until the collision between impact ring 66 and abutment face 64 on spline housing 42 occurs which completes the jar stroke on the drill string.

Thereafter, the driller may desire a bump stroke. If so, he will quickly lower the drill string so that the mandrel 36 moves downwardly relative to the housing 37. The piston 51 will be returned to its home position against shoulder 55 of hydraulic cylinder 45 by the action of spring 54. During the bump or return stroke, fluid may bypass the piston 51 from chamber 53 to chamber 52 either by going around the outside diameter of piston 51 or by going through the inside diameter of piston 51 and the gap between piston 51 and piston actuator 72 which is caused by the pressure difference between chambers 52, 53 compressing the spring 54. Because of the stretch and weight of the drill string, the mandrel 36 may travel very quickly relative to the housing 37 until the abutment surfaces 60 impact thus causing the bump in the drill string.

There has been described a specific embodiment of a jar tool according to the present invention in which many modifications may be made without departing from the invention which should, therefore, be defined in accordance with the accompanying claims.

I claim:

1. A jar tool comprising: a mandrel adapted for connection to a piece of drill string at one end of said tool; a housing axially movable relative to said mandrel and adapted for connection to said drill string at the opposite end of said tool; first and second pairs of abutment faces between said mandrel and said housing defining jar and bump positions of said tool, respectively, said first and second pairs of abutment faces located in an abutment chamber; a piston slidably located between walls of said mandrel and said housing and having valve means operable to regulate the passage of hydraulic fluid from a first chamber on one side of said piston between said mandrel and said housing to a second chamber on the other side of said piston between said mandrel and said housing, said valve means including passages for permitting said hydraulic fluid to flow through said piston and between said piston and said walls of said mandrel and housing; and sealing means between said housing and mandrel operable to seal said first pair of abutment faces from outside contamination in said abutment chamber and seal said abutment chamber from said first and second chambers, said first and second pairs of abutment faces being enclosed within said jar tool.

2. A jar tool as in claim 1 wherein said housing and mandrel comprise a plurality of connected sections, all of said sections of said housing together being axially movable relative to all of said sections of said mandrel.

3. A jar tool as in claim 2 wherein said end section of said housing closest to said section of said mandrel connected to said drill string includes seals between the inside and outside of said jar tool.

4. A jar tool as in claim 3 wherein said end section includes a removable cap, said cap containing said seals.

5. A jar tool as in claim 2 wherein a first impact ring is connected to said housing to act as one of said second pair of abutment faces, said impact ring being held in position by a section of said housing.

6. A jar tool as in claim 5 wherein a second impact ring is connected to said mandrel to act as one of said first pair of abutment faces, said impact ring being held in position by a section of said mandrel.

7. A jar tool as in claim 6 wherein said other of said first pair of abutment faces is part of a section of said housing, said section being said spline housing.

8. A jar tool comprising a mandrel adapted for connection to a piece of drill string at one end of said jar tool, said mandrel comprising a plurality of connected mandrel sections, a housing substantially surrounding said mandrel and adapted for connection at said opposite end of said jar tool to a piece of drill string, said housing comprising a plurality of connected housing sections, said mandrel being axially movable relative to said housing, a piston slidably located between walls of said housing and said mandrel and operable to restrict the flow of hydraulic fluid from a first chamber on one side of said piston to a second chamber on the other side of said piston, said piston including passages for permitting hydraulic fluid to flow through said piston and between said piston and said walls of said mandrel and housing, a first pair and a second pair of abutment faces in an abutment chamber between said mandrel and said housing and defining the impact position of said jar tool on said jar and bump strokes, respectively, and sealing means between said housing and mandrel operable to seal said first pair of abutment faces from outside contamination and seal said abutment chamber from said first and second chambers, said first and second pair of abutment faces being enclosed by said housing within said jar tool.

* * * * *